United States Patent [19]

Wolfger

[11] Patent Number: 4,862,589

[45] Date of Patent: Sep. 5, 1989

[54] DRY-SHAVING APPARATUS COMPRISING A SLIDABLE SHUTTER

[75] Inventor: Arno Wolfger, Klagenfurt, Austria

[73] Assignee: U.S. Philips Corp., New York, N.Y.

[21] Appl. No.: 184,311

[22] Filed: Apr. 21, 1988

[30] Foreign Application Priority Data

Apr. 24, 1987 [AT] Austria ..... 1029/87

[51] Int. Cl.[4] ..... B26B 19/20

[52] U.S. Cl. ..... 30/43; 30/43.92

[58] Field of Search ..... 30/32, 34 R, 43, 43.91, 30/43.92, 90

[56] References Cited

U.S. PATENT DOCUMENTS 3,538,604 11/1970 Walter et al. ..... 30/34 R

FOREIGN PATENT DOCUMENTS 1122410 1/1972 Fed. Rep. of Germany ..... 30/34 R

*Primary Examiner*—Douglas D. Watts

*Attorney, Agent, or Firm*—Ernestine C. Bartlett

[57] ABSTRACT

In a dry-shaving apparatus comprising a slidable shutter (3) for optionally covering or exposing a shear foil of the dry-shaving apparatus an arm (15) of a slide (14) for actuating a switch (11) in the motor circuit extends in the path of the shutter end which is remote from the shear foil when the shutter is moved away from the shear foil to expose the shear foil for the purpose of shaving, the free end of said arm being elastically deflectable transversely of the direction of movement of the shutter to interlock with the shutter end, so that upon a further movement of the shutter away from the shear foil the slide is moved via the arm and the switch is actuated.

3 Claims, 2 Drawing Sheets

DRY-SHAVING APPARATUS COMPRISING A SLIDABLE SHUTTER

BACKGROUND OF THE INVENTION

The invention relates to a dry-shaving apparatus comprising a slidable shutter for optionally covering or exposing a shear foil of a dry-shaving apparatus, and by means of which shutter, with the shutter end which is remote from the shear foil, a switch in the motor circuit of the dry-shaving apparatus can be actuated to switch on the motor when the shutter is slid away from the shear foil to expose the shear foil for the purpose of shaving. In such a dry-shaving apparatus, as is known from DE-OS 17 03 169, a switch arranged in the motor circuit is actuated directly by the shutter end at the end of the shutter displacement away from the shear foil. This largely dictates the position of the switch, so that this position cannot be adapted to other conditions.

SUMMARY OF THE INVENTION

It is the object of the invention to provide optimum freedom in choosing the position of the switch in a dry-shaving apparatus comprising a shutter for optionally covering or exposing a shear foil and a switch which can be activated to switch on the motor when the shutter is slid away to expose the shear foil a further object of the invention is to guarantee a reliable actuation of the switch in such a shaver by means of the shutter. According to the invention an arm of a slide which actuates the switch extends into the path of the shutter end which is remote from the shear foil when the shutter is moved away from the shear foil to expose the shear foil for the purpose of shaving. The free end of the arm is constructed to be elastically deflectable transversely of said direction of shutter movement and at the location of the shutter end can interlock with said shutter end to move the slide via the arm and thereby close the switch when the shutter is slid further away from the shear foil. Since the switch is actuated via a separate slide there are more possibilities with respect to the choice of the position of the switch itself, the interlocking between the shutter end and the free end of the arm guaranteeing a reliable actuation of the slide by the shutter and thus a reliable actuation of the switch. Several known constructions are available to obtain such an interlocking, their essential feature being a projection on one part locking into a recess in the other part attended by a temporary elastic deflection of one of the two parts.

Preferably, in the path behind the interlocking between the shutter end and the free end of the arm of the slide, when the shutter is moved further away from the shear foil, an abutment for the elastically deflectable free end of the arm is provided on the apparatus to counteract a deflection of said arm transversely of the direction of said path and to preclude de-interlocking. This ensures that after interlocking with the shutter end the free end of the arm of the slide can no longer deflect when the shutter is moved further away from the shear foil, so that the interlocking can no longer be released, which guarantees a very reliable actuation of the switch.

In principle, the position of the free end of the slide can be selected arbitrarily in the transverse direction of the shutter end. However, it is found to be advantageous if, in a dry-shaving apparatus in which the shutter is guided laterally at both sides in groove-shaped guides on the dry-shaving apparatus, the shutter, at the location of the shutter end which is remote from the shear foil, comprises a lateral projection extending into one of the two lateral guides. most preferably the guide in which said projection extends has an opening through which the free end of the arm of the slide extends into the guide and along which opening said free end is movable after interlocking with the projection when the shutter is moved further away from the shear foil. Thus, the interlocking mechanism is in principle not visible and accesible to a user of such a dry-shaving apparatus, because it is situated inside the guide for the shutter. It is to be noted that a dry-shaving apparatus in which the shutter is guided laterally at both sides in groove-shaped guide means of the dry-shaving apparatus is known per se from DE-AS 11 22 410. However, this known dry-shaving apparatus does not comprise a switch in the motor circuit of the dry shaving apparatus which is actuated by means of the shutter.

BRIEF DESCRIPTION OF THE DRAWINGS

An embodiment of the invention will now be described in more detail, by way of example, with reference to the accompanying drawings.

DETAILED DESCRIPTION OF THE PREFERRED EMBODIMENTS

Figure 1:
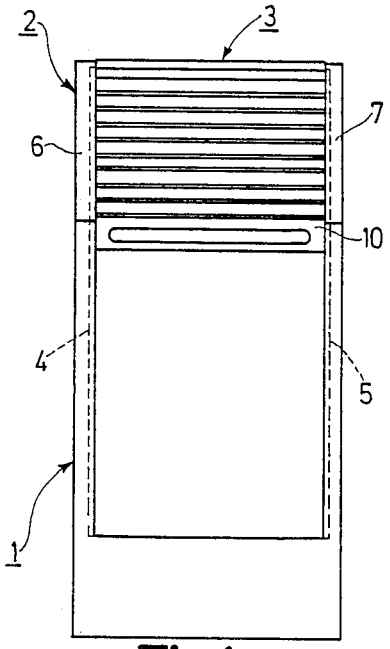
FIG. 1 shows a dry-shaving apparatus with a shutter covering the shear foil.
Figure 2:
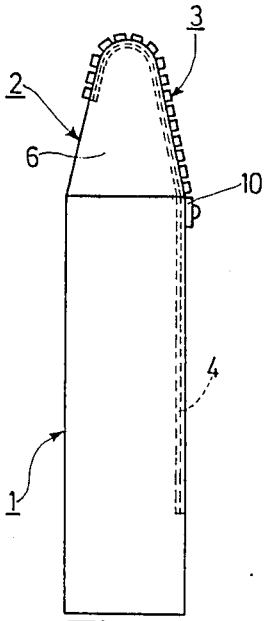
FIG. 2 is a side view of the dry-shaving apparatus of FIG. 1.
Figure 3:
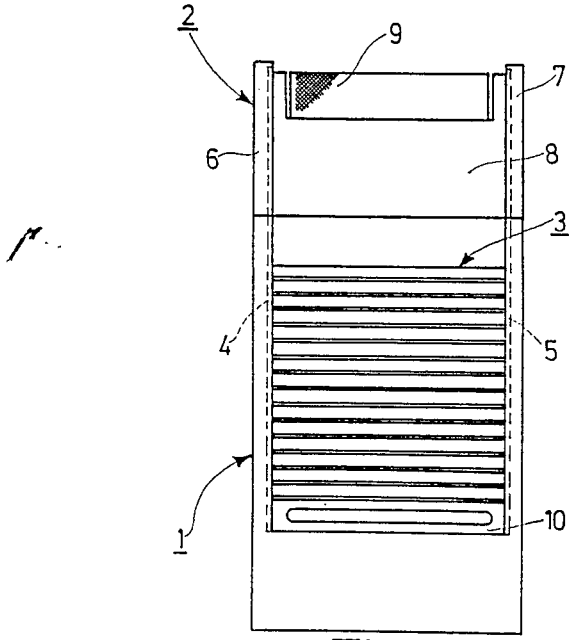
FIG. 3, in the same way as FIG. 1, shows the dry-shaving apparatus of FIG. 1. with the shear foil exposed by the shutter.

FIGS. 1 and 2 show a dry-shaving apparatus 1 comprising a basic apparatus on which a shaving-head frame 2 is placed. In a manner not shown, for example by means of at least one resilient latch the shaving-head frame 2 is detachably secured to the basic apparatus 1. Such a shaving-head frame serves for retaining an arcuate shear foil which in FIG. 1 and 2 is covered completely by a shutter 3 to protect the shear foil when the dry-shaving apparatus is not in use. Such a shutter 3 is arranged to be slidable on the dry-shaving apparatus, said shutter being guided laterally at both sides in groove-shaped guides 4 and 5 on the dry-shaving apparatus, as is indicated in broken lines in FIGS. 1 and 2. As can be seen, the shutter 3 can be slid from the basic apparatus onto the shaving-head frame and the shear foil, for which purpose the shutter guides 4 and 5 in the basic apparatus 1 are continued in the side walls 6 and 7 of the shaving head frame 2, said guide means being curved in conformity with the curvature of the shear foil. If the dry-shaving apparatus is to be used, the shutter 3 is slid back onto the basic apparatus 1 out of its position shown in FIG. 2 until it exposes the shear foil to allow shaving. As is shown in FIG. 3, the shutter in the present case is situated completely on the basic apparatus 1 to expose the shaving-head frame in whose cross-members 8 the shearfoil 9 is mounted. In this position of the shutter, which may be defined for example by means of a latch, the shutter end 10 which is remote from the shear foil and which is constructed, for example, as a gripping element for the shutter, actuates a switch situated in the motor circuit of the dry-shaving apparatus to switch on the motor, so that the dry-shaving apparatus is now ready for shaving.

Such an actuation of the switch by means of the shutter end 10 will now be described in detail with reference to FIGS. 4 to 7. The switch 11, which is arranged in a motor circuit of the dry-shaving apparatus, for switching on the motor, not shown, is secured to the housing wall 12 of the basic apparatus 1, the switch being situated in the area of the end of the guide 4 for the shutter 3 which is remote from the shear foil. The switch 11 is constructed as a slide switch comprising an actuating element 13 which cooperates with a slide 14 for the actuation of the switch 11. This slide 14, which comprises an arm 15, extends in an opening 16 formed in the housing wall 12, the free end of the arm 15 extending into the guide 4 through an opening 17 at the location of a side wall of the groove-shaped guide 4. The shutter 3, which is guided laterally in the guides 4 and 5 in a manner not shown, can slide away from the shear foil, as is indicated by the arrow 18. The shutter end 10 is provided with a lateral projection 19, which is pin-shaped in the present case and which engages in the groove-shaped guide 4. Further, the free end of the arm 15 of the slide 14 is elastically deflectable transversely of the direction of movement of the shutter 3 indicated by the arrow 18 by giving it an appropriate shape or by an appropriate choice of the material and is provided with a run-on surface 20 which, viewed in the direction of the arrow 18, is situated before a recess 21 in the free end of the arm 15. By means of this recess 21 in the free end of the arm 15 of the slide 14 and the lateral projection 19 on the shutter end 10 the shutter 3 is coupled to the slide 14, so that the slide 14 is moved and the switch 11 is closed when the shutter 3 is moved away from the shear foil.

Figure 4:
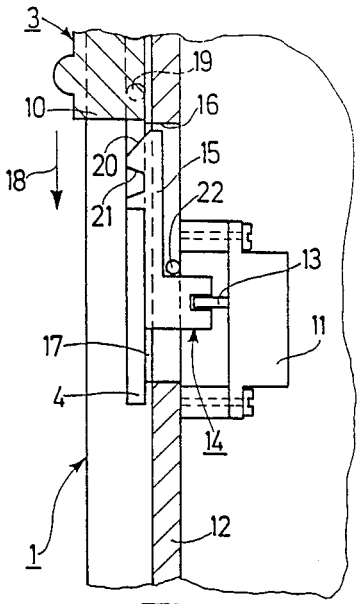
FIG. 4, in the same way as FIG. 2, is a sectional view of a part of the dry-shaving apparatus at the location of the lateral guide for the shutter, the shutter not being yet coupled to the free end of the arm of the swich-actuating slide.
Figure 5:
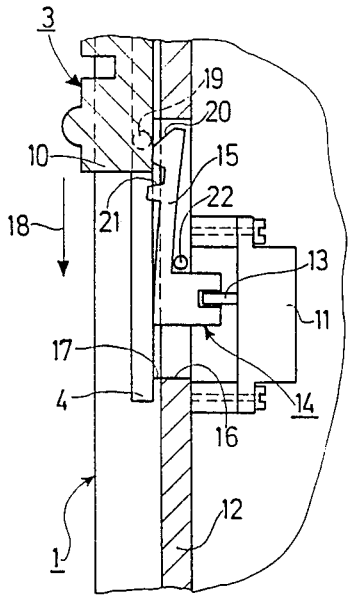
FIG. 5 shows the part of the dry-shaving apparatus of FIG. 4 when the coupling between the shutter end and the free end of the arm of the switch-actuating slide just begins.
Figure 6:
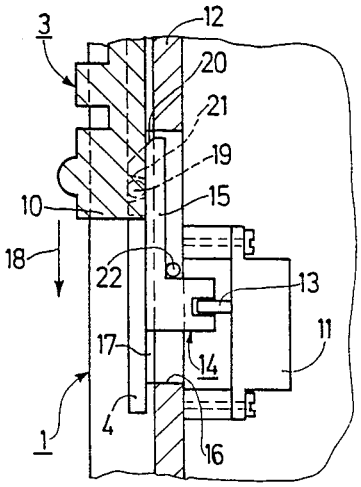
FIG. 6 shows the part of the dry shaving apparatus of FIG. 4 after coupling of the shutter end to the free end of the arm of the switch-actuating slide.

In the position of the shutter 3 shown in FIG. 4 the shutter end 10 is not yet coupled to the free end of the arm 15, because in the direction of movement of the shutter indicated by the arrow 18 the projection 19 on the shutter end 10 which extends into the guide 4 is still situated before the free end of the arm 15 when the shutter is slid away from the shear foil. As the shutter 3 is slid further away from the shear foil the projection 19 reaches the run-on surface 20 on the free end of the arm 15 and runs onto this surface, the free end of the arm 15 of the slide 14 being deflected as a result of its elasticity, out of the path of the projection 19 transversely of the direction of movement of the shutter 3 indicated by the arrow 18, as is illustrated in FIG. 5. If the shutter 3 is slid further away from the shear foil the projection 19 reaches the recess 21 in the free end of the arm 15 and snaps into this recess, as is shown in FIG. 6. In this way a projection 19 on the shutter end 10 and the free end of the arm 15 of the slide 14 are interlocked, so that when the shutter 3 is moved further away from the shear foil the slide 14 is also moved, to actuate the actuating element 13 of the switch 11, thus closing the switch 11, as is indicated in FIG. 7.

Figure 7:
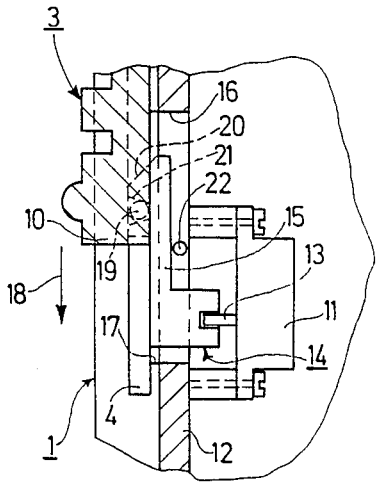
FIG. 7 shows the part of the dry-shaving apparatus of FIG. 4 when the slide has been moved by the shutter and the switch has been actuated after coupling of the shutter and to the free-end of the arm of the switch-actuating slide.

If the shutter 3 is slid out of the position shown in FIG. 7, in which the switch 11 is closed towards the shear foil in the opposite directin a similar inserted cycle of movements is obtained. The slide 14 is first moved by the shutter 3 into the position in which the switch 11 is opened, after which the slide 14 can no longer follow a further movement of the shutter 3. The projection 19, which cooperates with an inclined position of the recess 21, moves the free end arm 15 of the transversely of the direction of movement of the shutter 3 until the projection 19 becomes disengaged from the recess 21, so that the coupling between the shutter 3 and the slide 14 is released and the shutter 3 can now be moved along towards the shear foil.

In the present embodiment as shown in FIG. 7, an abutment for the elastic free end of the arm 15 is provided on the apparatus in the path of movement. The abutment when the shutter is moved further away from the shear foil after the shutter end 10 has interlocked with the free end of the arm 15 of the slide 14, as is shown in FIG. 6, counteracts a movement of said end transversely of the direction indicated by the arrow 18 to prevent de-interlocking. In the present case this abutment on the apparatus is constituted by a pin 22 arranged in the opening 16 in the housing wall 12, which pin lies against that side of the arm 15 of the slide 14 which is remote from the guide 4. As can be seen in FIG. 6, the position of the pin 22 is selected in such a way that it does not support the free end of the arm 15 until immediately after the shutter end 10 and the free end of the arm 15 have interlocked, ensuring that as a result of its elasticity said end is movable transversely of the direction of movement of the shutter 3, thereby enabling it to be coupled to the shutter end 10. However, as soon as the slide 14 is moved by the shutter end 10 the pin 22 comes closer to the free end of the arm 15. The pin 22, as can be seen in FIG. 7, then supports the free end of the arm 15 of the slide 14 in such a way that it can no longer deflect elastically and consequently cannot move transversely of the direction of movement of the shutter. In this way along said part of the path of movement of the shutter 3, the projection 19 on the shutter end 10 cannot snap out of the recess 21 in the free end of the arm 15 of the slide 14 and thus an inadvertent disengagement of the coupling between the shutter 3 and the slide 14 is precluded. As a result of this, the actuation of the switch 11 by means of the shutter 3 is effected in a very reliable manner. Obviously, the construction of such an abutment on the apparatus for the elastic free end of the arm 15 of the slide 14 can be realized in other ways. For example, the free end of the arm 15 may be provided with a pin which extends into guide 4, a recess which extends into the guide 4 ensuring that only in the positions of the slide 14 shown in FIGS. 4, 5 and 6 the pin can leave the guide 4 and the free end of the arm 15 of the slide 14 can deflect transversely of the direction of movement of the shutter to establish or release the coupling between the shutter 3 and the slide 14.

As can be seen, the steps described in the foregoing ensure a reliable actuation of the switch 11 by means of the shutter 3, while the choice of the position of the switch 11 relative to the direction of movement of the shutter can be varied depending on the construction of the slide 14 which cooperates with the switch 11. Since the switching strokes of such switches 11 are comparatively short, it may also be effective if, in the customary manner, lost motion is introduced in the cooperation between the slide 14 and the actuating element 13 of the switch 11 to extend the switching path for the shutter 3. It is obvious that several modifications of the embodiment described in the foregoing are possible within the scope of the invention. This applies in particular to the manner in which and at which location the coupling between the shutter end 10 and the slide 14 is established. For example, the free end of the arm 15 of the slide 14 may also project into the guide 4 through an opening formed in the bottom wall of the groove-shaped guide 4.

What is claimed is:

1. A dry-shaving apparatus comprising a shear foil, a switch in the motor circuit of the apparatus, a slidable shutter for optionally covering or exposing the shear foil by means of which shutter, with the shutter end which is remote from the shear foil, the switch can be actuated to switch on the motor when the shutter is slid away from the shear foil to expose the shear for for the purpose of shaving, wherein an arm of a slide which actuates the switch extends into the path of the shutter end which is remote from the shear foil, when the shutter is moved away from the shear foil to expose the shear foil for the purpose of shaving, the free end of the arm is elastically deflectable transversely of said direction of movement and at the location of the shutter end is interlockable with said shutter to move the slide via the arm and thereby close the switch when the shutter is slid further away from the shear foil.

2. A dry-shaving apparatus as claimed in claim 1, wherein in the path behind the interlock between the shutter end and the free end of the arm of the slide, when the shutter is moved further away from the shear foil, an abutment for the elastically deflectable free end of the arm is provided on the apparatus to counteract a deflection of said arm transversely of the direction of said path and to preclude de-interlocking.

3. A dry-shaving apparatus as claimed in claim 1 or 2, wherein:

the shutter is guided laterally at both sides in groove-shaped guides on the dry-shaving apparatus the shutter, at the location of the shutter end which is remote from the shear foil and comprises a lateral projection extending into one of the two lateral guides, the guide in which said projection extends has an opening through which the free end of the arm of the slide extends into the guide and along which opening said free end is movable after interlocking with the projection when the shutter is moved further away from the shear foil.

* * * * *